US005141300A

United States Patent [19]

Ciesla

[11] Patent Number: 5,141,300

[45] Date of Patent: Aug. 25, 1992

[54] WALL-MOUNTED JEWELRY CABINET ASSEMBLY

[76] Inventor: Ethel Ciesla, 4696 Chapman Parkway, Hamburg, N.Y. 14075

[21] Appl. No.: 833,624

[22] Filed: Feb. 7, 1992

Related U.S. Application Data

[63] Continuation of Ser. No. 625,879, Dec. 11, 1990, abandoned.

[51] Int. Cl.[5] ..... A47B 67/02

[52] U.S. Cl. ..... 312/204; 312/245; 206/566; 206/45.15

[58] Field of Search ..... 312/204, 224, 245, 227; 206/45.15, 564, 566

[56] References Cited

U.S. PATENT DOCUMENTS

| | | | |
|---|---|---|---|
| 3,239,296 | 3/1966 | Langer | 312/204 |
| 3,639,022 | 2/1972 | Elmo | 312/245 |
| 4,324,446 | 4/1982 | LeSage | 312/245 |
| 4,413,736 | 11/1983 | Nibling | 312/245 |

*Primary Examiner*—Gerald A. Anderson

*Attorney, Agent, or Firm*—Hodgson, Russ, Andrews, Woods & Goodyear

[57] ABSTRACT

A wall-mounted jewelry cabinet assembly designed for the receipt of chains, necklaces, and the like as well as their accessories. The cabinet assembly (10) is formed of a base cabinet subassembly (12) and a cover subassembly (14), the cover subassembly being mounted on the base subassembly by hinge means (16) and which is adapted to be latched in a closed position by means of magnets (80, 82) which engage magnetic material (84, 86). The base cabinet subassembly is formed of a generally rectangular frame work (20, 22, 24, 26) and further includes a back, border boards, and a pocket forming board all of which are covered by a fabric-like material (42) of pleasing appearance. A plurality of hooks (44) are provided on an upper portion of the back for the receipt of chains and the like. A pocket forming board extends across the lower forward portion of the base cabinet assembly and forms a pocket for the receipt of accessories. The cover subassembly consists primarily of a picture frame (60, 62, 64, 66) the back of which is also covered by the fabric-like material (42).

4 Claims, 2 Drawing Sheets

Fig. 1.
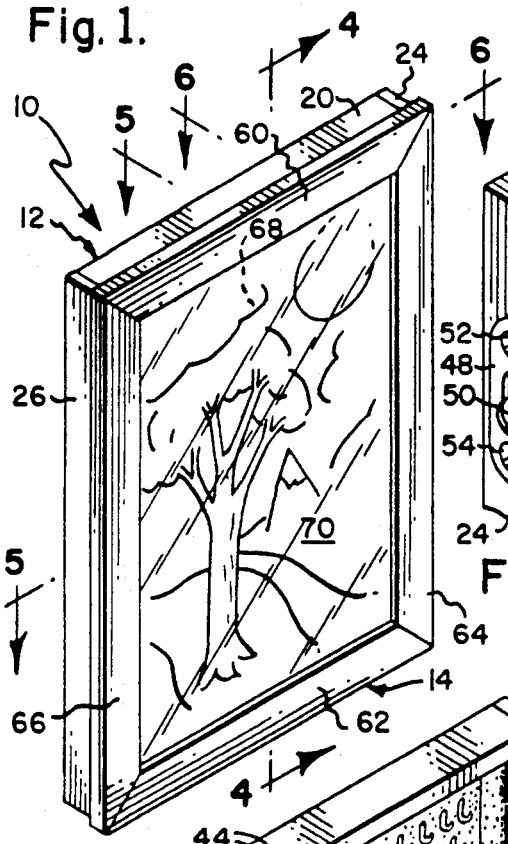
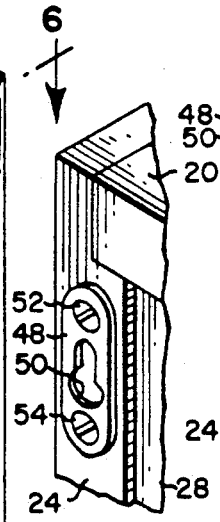
Fig. 2a.
Fig. 2.
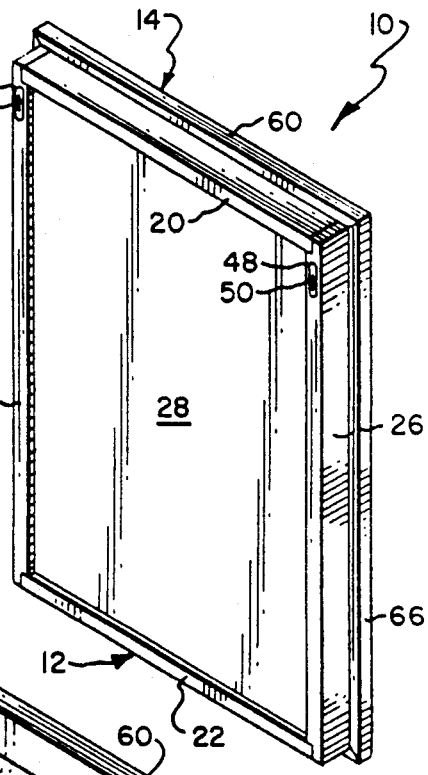
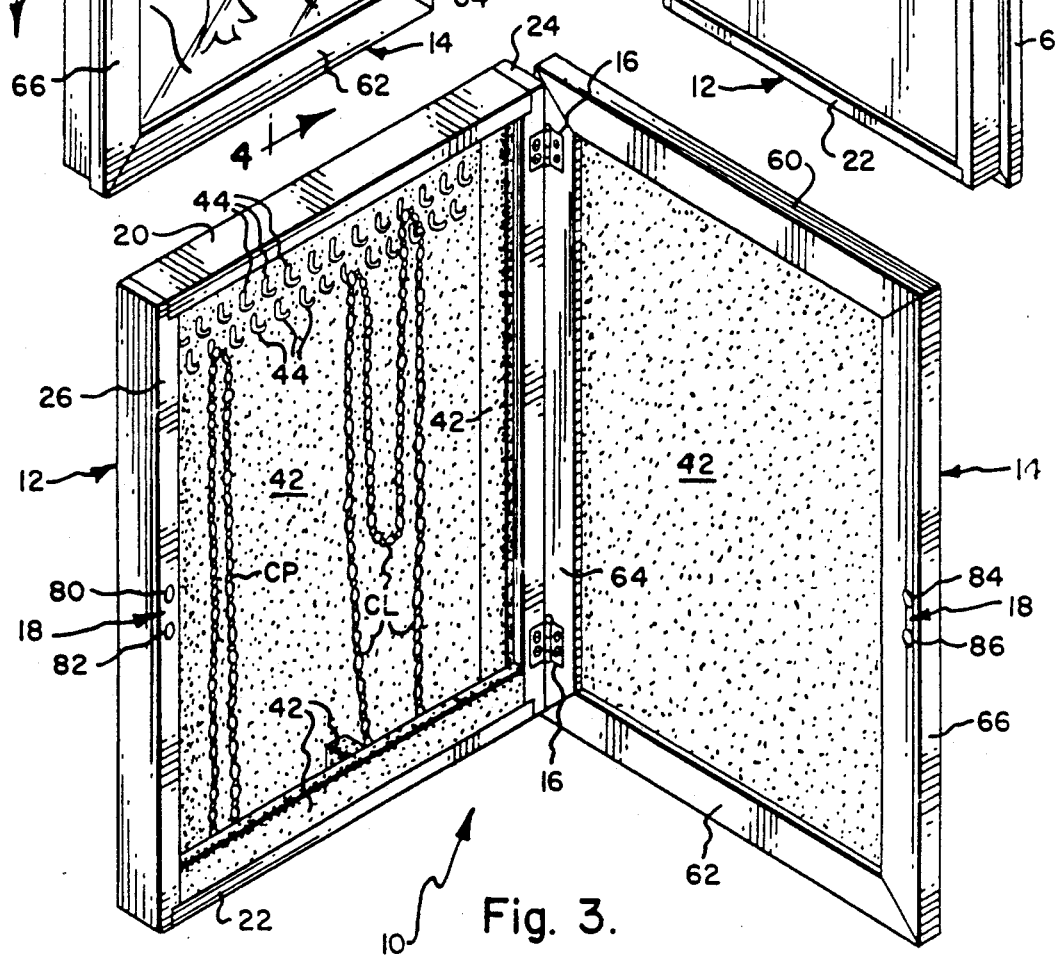
Fig. 3.

Fig. 4.
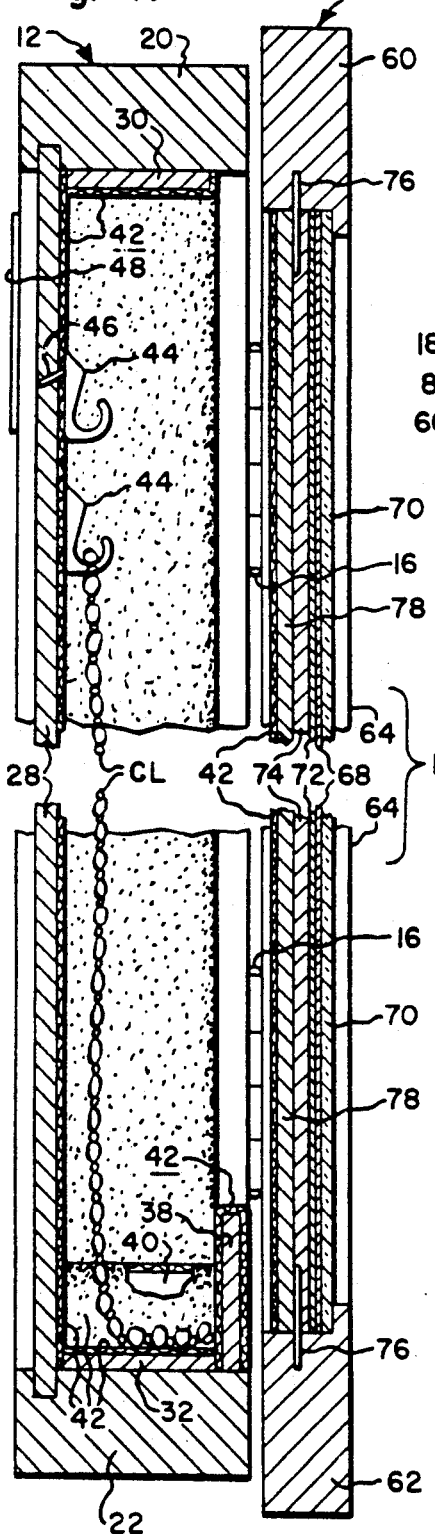
Fig. 5.
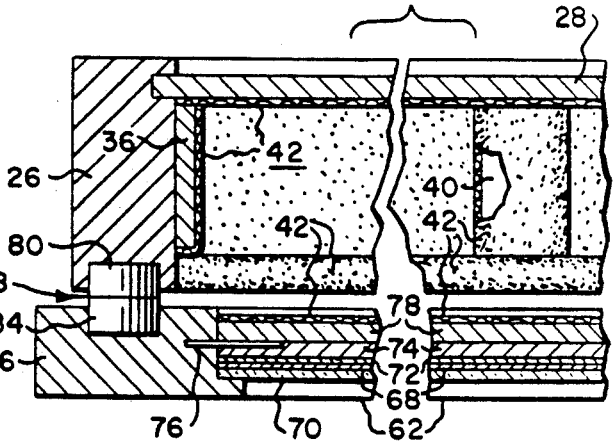
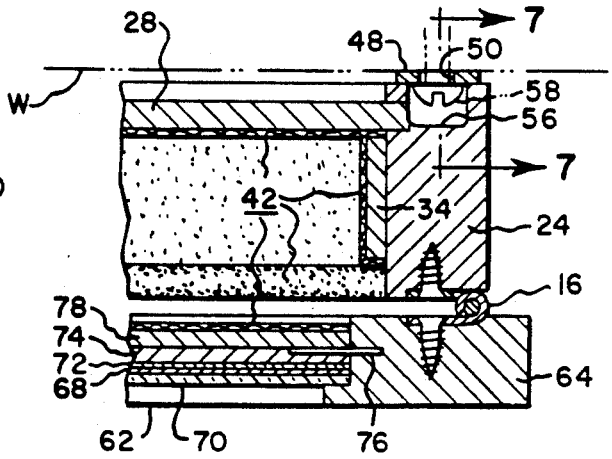
Fig. 6.
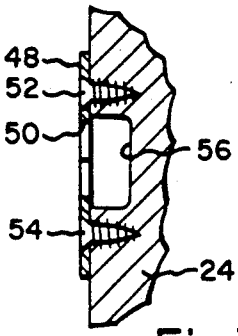
Fig. 7.
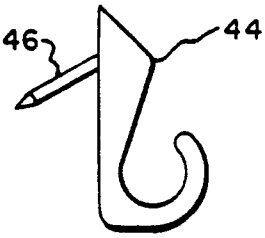
Fig. 8.

WALL-MOUNTED JEWELRY CABINET ASSEMBLY

This is a continuation of copending application Ser. No. 07/625,879 filed on Dec. 11, 1990 now abandoned.

TECHNICAL FIELD

The present invention relates generally to cabinets, and more particularly to a wall-mounted jewelry cabinet for holding necklaces, chains, and the like as well as small accessories.

BACKGROUND OF THE INVENTION

Jewelry such as necklaces and chains are frequently stored in jewelry boxes. A typical jewelry box is most frequently placed upon a dresser or the like, the jewelry box being of a chest type typically having one or more small trays and a large general catch-all area. Typically, small accessories such as pins and earrings are placed in the trays and larger pieces such as necklaces or chains are placed in the larger area. If a number of chains or necklaces are stored in the larger area it is quite possible that they may become entangled with each other. This is particularly the case if small-diameter chains of long length are stored. Thus, many people have 18 to 24 inch long gold necklaces of relatively small diameters which easily become entangled with each other. In order to prevent this entanglement problem, many people have adopted the practice of placing small nails in the back of their closet upon which they hang their chains. While this solution is generally satisifactory, it may result in the chains being knocked from the nails onto the floor where they can again become entangled with themselves or with other chains which have also been knocked to the floor. In addition, because of the clothes which typically hang in front of the necklaces it is difficult to see what necklaces are available when selecting a necklace for evening wear.

In order to overcome the disadvantages of the dresser-mounted chest-type jewelry boxes as well as other practices of storing necklaces, it has been proposed in the past to provide wall-mounted jewelry box assemblies. Typical examples are U.S. Pat. No. 4,304,447 issued Dec. 8, 1981 to Ellwood et al and U.S. Pat. No. 4,413,736 issued Nov. 8, 1983 to Nibling. While both of these wall-mounted jewelry box assemblies are satisfactory for their intended appearance and provide a pleasing appearance, in that they include a framed picture, they have the disadvantages in that they do not provide any means for storing small accessories, such as earrings and pins, which may be associated with the necklaces that are to be stored within the cabinet.

OBJECTS OF THE PRESENT INVENTION

It is an object of the present invention to provide a wall-mounted jewelry cabinet assembly which overcomes the disadvantages of the known prior art.

More particularly it is an object of the present invention to provide a wall-mounted jewelry cabinet assembly which can receive long necklaces and chains, as well as accessories therefor.

It is an additional object of the present invention to provide a wall-mounted jewelry cabinet assembly of pleasing appearance having a hinged cover movable subassembly between open and closed positions, and a base cabinet subassembly which includes pockets for the reception of small accessories.

The foregoing objects as well as other objects and advantages of the present invention will become more apparent after a consideration of the following detailed description taken in conjunction with the accompanying drawings in which a preferred form of the present invention is illustrated.

BRIEF DESCRIPTION OF THE DRAWINGS

FIG. 1 is a front perspective view of the wall-mounted jewelry cabinet assembly of the present invention, the cover subassembly being shown in its closed position.

FIG. 2 is a view similar to FIG. 1 but taken from the rear.

FIG. 2*a* is an enlarged detail of a portion of the assembly shown in FIG. 2 illustrating one of the mounting means used for mounting the jewelry cabinet assembly upon a wall.

FIG. 3 is a front perspective view of the wall-mounted jewelry cabinet assembly shown in FIG. 1 with the cover subassembly in its open position.

FIG. 4 is a partial sectional view taken generally along the line 4—4 in FIG. 1.

FIG. 5 is a partial sectional view taken generally along the line 5—5 in FIG. 1.

FIG. 6 is a sectional view taken generally along the line 6—6 in FIG. 1.

FIG. 7 is a sectional view taken generally along the line 7—7 in FIG. 6 with the wall-mounting fastener being omitted.

FIG. 8 is an enlarged view of the chain or necklace hook shown in FIG. 4.

DETAILED DESCRIPTION

With reference initially to FIGS. 1 through 3, the wall-mounted jewelry cabinet assembly of this invention is indicated generally at 10. The cabinet assembly includes two major subassemblies, one of these being a base cabinet subassembly indicated generally at 12, and the other being a cover subassembly indicated generally at 14. The cover subassembly is secured to the base subassembly by means of one or more hinges 16 which can be of any conventional construction. In addition, latch means are provided for securing the parts together, which latch means are indicated generally at 18 in FIG. 5. The latch means are preferably magnetic in nature and will be described below.

The base cabinet subassembly includes, as its major components, top and bottom horizontal frame members 20, 22, respectively, as well as interconnected right and left vertically extending frame members 24, 26, respectively. A rear portion of each of the frame members is provided with a suitable groove (no number) which can receive a back 28 in the form of a board. The frame members 20 through 26 and back 28 are secured to each other in any conventional manner, such as by gluing or the like. When assembled they form a generally rigid rectangular structure. Border boards are provided which extend along inner sides of the frame members 20 through 26 from the front surface of the back 26 to a location spaced slightly inwardly of the front surface of the frame members, the top and bottom border boards being indicated at 30 and 32, respectively and the right and left border boards being indicated at 34 and 36, respectively.

In accordance with the principals of the present invention, the base subassembly further includes a pocket forming board 38 which has its lower edge in contact with the bottom board. The pocket forming board 38 abutts the front edge of the bottom border board 32 lower front edges of the right and left border boards 34, 36. A pocket divider board 40 is provided which extends between a lower central portion of the back and an intermediate portion of the pocket forming board 38. As shown in the drawings, when the jewelry cabinet assembly is mounted upon a wall all visually perceivable surfaces of the border boards, back, and pocket forming boards, including the pocket divider, are covered with a fabric-like material 42 which is of a pleasing appearance and which may also have good touch appeal. A typical fabric or fabric-like material 42 may be a velour or a satin. The material may be secured over the various surfaces in any manner.

The base cabinet further includes hardware in the form of hooks and a pair of mounting brackets. The hooks 44 are of the form illustrated in the drawings and include a fastener portion 46 which may be driven through the fabric-like material 42 into the back 28 to secure the hook in place. As can be seen in FIG. 3, a plurality of rows of hooks may be mounted on the upper front surface of the back. Each of the mounting brackets include plate-like metal structure 48 provided with a keyhole opening 50 spaced between upper and lower countersunk openings which are adapted to receive upper and lower flat head wood screws 52, 54, respectively. Each keyhole opening is adapted to overlie a recess 56. As can be seen from FIG. 2, two mounting brackets are provided, one adapted to be secured to an upper rear portion of the right-hand frame member 24 overlying an appropriate recess 56, and the other being secured to the upper rear portion of the left frame member 26 also overlying an appropriate recess. The base cabinet subassembly can be readily mounted on a wall, indicated by the broken line W in FIG. 6 by any suitable fastener such as, for example, a round head screw 58.

The cover subassembly 14 includes a generally conventional rectangular picture frame having a top member 60, a bottom member 62, and right and left side members 64, 66, respectively. The frame typically includes a picture 68 sandwiched between a pane of glass 70 and picture backing paper 72, and further includes an interior picture backing board 74, all of the parts being held together in their assembled position by conventional fastening means indicated at 76, which fastening means may be glazier points or staples. In order to provide a pleasing appearance to the back of the picture frame, an exterior picture backing board 78 is provided which is preferably adhesively secured to the interior picture backing board. The visually perceivable surface of the exterior picture backing board 78 is covered by the fabric-like material 42 or by a complementary material.

The latch means 18 in the illustrated embodiment include upper and lower spaced apart magnets 80, 82, respectively, received in suitable recesses in the left vertically extending frame member 26 and upper and lower elements formed of a magnetic material, the elements being indicated at 84 and 86, respectively. The magnetic material may be another magnet with the opposite pole engaging the pole of the associated magnet, or simple any magnetic ferrous material.

It can be seen from the foregoing that the disadvantages of the prior art have been overcome while providing a wall-mounted jewelry cabinet assembly of relatively simple construction and of pleasing appearance, which wall-mounted cabinet is particularly suitable for its intended purposes. A jewelry chain having a pendant, such as that shown at CP may be hung from a hook with the pendant being received in the pocket. Very long chains may be looped over two spaced apart hooks as shown at CL.

While a preferred form in which the principles of the present invention have been incorporated has been described above and shown in the accompanying drawings, it is to be understood that the invention is not intended to be limited to the particular details shown and described above, but is only to be limited to the breadth of the following claims.

What is claimed is:

1. A wall-mounted jewelry cabinet assembly comprising:

a base cabinet subassembly including a generally rectangular framework formed of interconnected top, bottom, right, and left frame members having front and rear portions, a back secured to the rear portions of the top, bottom, right, and left frame members, a separate pocket forming frame member parallel to the back and spaced forwardly of and away from the back and in contact with right, left, and bottom frame members, the pocket forming frame member cooperating with the bottom, right, and left frame members and the back to form a pocket which may receive pins, broaches, rings, earrings, and other small items of jewelry, a fabric-like material having a pleasing appearance which overlies visually perceivable surfaces of the back and pocket forming member, and a plurality of hooks, each of which has a mounting portion which passes through the fabric-like material on the back and which is secured to an upper portion of the back board;

a cover subassembly including a picture frame, a picture within the frame, an exterior picture backing board disposed within the picture frame, and fabric-like material of a pleasing appearance which covers the exterior surface of the exterior picture backing board; and hinge means for connecting the picture frame with the base cabinet subassembly for swinging movement of the picture frame between open and closed positions, the picture frame being connected to the base cabinet subassembly to overlie said framework and said pocket forming member when in the closed position, said pocket forming member being a barrier between the picture frame and jewelry dangling from the hooks into the pocket.

2. The cabinet assembly as set forth in claim 1 wherein the cover subassembly further includes an interior picture backing board disposed between the exterior picture backing board and the picture, fastening means for holding the interior picture backing board closely adjacent the picture within the frame and wherein the exterior picture backing board is adhesively secured to the interior picture backing board.

3. A wall-mounted jewelry cabinet assembly comprising:

a base cabinet subassembly including a generally rectangular framework formed of interconnected top and bottom horizontal frame members and right and left vertically extending frame members, each frame member having inner and outer sides and front and rear portions, the front portions having front surfaces, a back secured to rear portions of the frame member of the generally rectangular framework, border boards which extend along the inner sides of the vertically extending frame members and which have front surfaces which are spaced rearwardly of the front surfaces of the vertically extending frame members, a separate pocket forming frame member parallel to the back and spaced forwardly of and away from the back and having right and left edges, the pocket forming frame member cooperating with the bottom, right, and left frame members and the back to form a pocket which may receive pins, broaches, rings, earrings, and other small items of jewelry, a fabric-like material having a pleasing appearance which overlies visually perceivable surfaces of the back, border boards, and pocket forming frame member, and a plurality of hooks, each of which has a mounting portion which passes through the fabric-like material and which is secured to an upper portion of the back;

a cover subassembly including a picture frame; and hinge means for connecting the picture frame with the base cabinet subassembly for swinging movement of the picture frame between open and closed positions, and wherein the fabric-covered pocket forming frame member overlies and abuts the front surfaces of the fabric-covered border boards with the right and left edges of the fabric-covered pocket forming frame member abuttingly engaging the right and left side frame members respectively.

4. The cabinet assembly as set forth in claim 3 further characterized by the provision of a pocket divider board extending between a lower central portion of the back and an intermediate portion of the pocket forming frame member, the visually perceivable surface of the pocket divider board also being covered by the fabric-like material.

* * * * *